United States Patent [19]

Pelto-Huikko

[11] Patent Number: 5,048,644

[45] Date of Patent: Sep. 17, 1991

[54] METHOD FOR IMPROVING THE PERFORMANCE OF A MOTOR CONTROLLED HYDRAULIC ELEVATOR

[75] Inventor: Raimo Pelto-Huikko, Vantaa, Finland

[73] Assignee: Kone Oy, Hyvinkaa, Finland

[21] Appl. No.: 266,608

[22] Filed: Nov. 3, 1988

[30] Foreign Application Priority Data

Nov. 4, 1987 [FI] Finland ..... 874863

[51] Int. Cl.[5] ..... B66B 11/04

[52] U.S. Cl. ..... 187/17; 187/29.2; 91/454; 60/466

[58] Field of Search ..... 187/17, 29.2, 110, 111; 91/449, 452, 454, 446; 60/466

[56] References Cited

U.S. PATENT DOCUMENTS

| | | | |
|---|---|---|---|
| 2,768,500 | 10/1956 | Tyler | 60/466 |
| 4,179,889 | 12/1979 | Gondek | 91/454 |
| 4,211,254 | 6/1980 | Dyal | 60/466 |
| 4,637,495 | 1/1987 | Blain | 187/29 A |
| 4,676,140 | 6/1987 | Haussler | 187/17 |

FOREIGN PATENT DOCUMENTS

| | | | |
|---|---|---|---|
| 3414793A1 | 10/1984 | Fed. Rep. of Germany . | |
| 3629032 | 8/1988 | Fed. Rep. of Germany | 187/17 |
| 71710 | 4/1985 | Finland . | |
| 5130335 | 5/1978 | Japan | 187/17 |
| 54-18568 | 2/1979 | Japan | 187/17 |

*Primary Examiner*—Robert P. Olszewski
*Assistant Examiner*—Kenneth Noland
*Attorney, Agent, or Firm*—Fleit, Jacobson, Cohn, Price, Holman & Stern

[57] ABSTRACT

The invention concerns a method and apparatus for improving the performance of a motor-controlled hydraulic elevator, in which oil is pumped using an hydraulic pump controlled by an electric motor from a container via a main supply duct into a lifting cylinder to move the elevator upwards, and returned in a controlled manner through the pump into the container to move the elevator downwards. In order to improve the loading conditions of the motor during down-travel, the oil pressure in the main duct is reduced to a substantially predetermined constant level by means of a check valve or lowering valve which, to provide compensation for the pressure in the pump, has a feedback connection to the main duct via a pressure compensation valve which controls the volume of flow through the check valve or lowering valve.

9 Claims, 2 Drawing Sheets

METHOD FOR IMPROVING THE PERFORMANCE OF A MOTOR CONTROLLED HYDRAULIC ELEVATOR

BACKGROUND OF THE INVENTION

1. Field Of The Invention

The present invention relates to a method and apparatus for improving the performance of an hydraulic elevator driven by means of an hydraulic pump controlled by an electric motor, whereby oil is pumped from a container via a main supply duct into a lifting cylinder to move the elevator upwards and the oil is returned in a controlled manner through the pump to the container to move the elevator downwards.

2. Description Of Related Prior Art

The travelling speed of an hydraulic elevator is controlled either in the traditional manner using a control valve (as in U.S. Pat. Nos. 3,842,943 and 4,249,641) or by varying the rotational speed of the electric motor actuating the pump. An example of the latter method is found in British patent publication No. 1,522,044. As the present invention proposes an improvement to the motor-controlled systems, such systems will be considered in the following discussion.

Generally speaking, in a motor-controlled system, the elevator is driven upward in the following manner:

the control system for driving the elevator upward starts operation of the electric motor and the pump and begins to accelerate the motor and pump according to a definite scheme;

the pressure of the oil flowing from the pump opens a check valve placed between the pump and the cylinder, so that the oil flowing into the cylinder begins to push up the piston. As the rotation of the pump is accelerated, the speed of movement of both the piston and of the elevator car increase accordingly;

when the elevator car has reached the desired speed, the electric motor and the pump continue running at a constant speed;

when the elevator approaches the desired floor, the control system reduces the speed of rotation of the motor in such a way as to decelerate the elevator in the desired manner when the car approaches the floor level; and when the elevator car has reached the level of the desired floor and the electric motor is running so slowly that the pump only produces a flow corresponding to its internal leakages, the spring-loaded check valve between the pump and the cylinder is closed. The motor can now be stopped, whereupon the car, supported by the check valve, remains standing at the floor level.

The downward movement of the elevator is also controlled by means of the electric motor, because this makes it possible to use the same control system as for upward drive:

the check valve, or a lowering valve shunting the check valve, is opened by means of a magnetic valve;

the oil is allowed to flow from the cylinder into the pump, which thus begins to rotate, functioning as an hydraulic motor;

the control system adjusts the speed of the electric motor to brake the pump so as to achieve the desired change in the speed of the elevator car, be it acceleration, driving at constant speed, or deceleration; and at the final stage of deceleration, when the car is approaching the desired level at a low speed, the control current to the check valve (lowering valve) is cut off, whereupon the valve is closed and the elevator comes to a halt. The supply of electricity to the motor can now be switched off.

It is desirable that the energy transferred from the pump to the electric motor during downward drive should be fed back to the mains. When a squirrel cage motor is used, this only occurs when the motor is running at a speed exceeding its synchronous speed. However, in many cases the oversynchronous lag of the motor together with the internal leakage of the pump result in an excessive speed of downward travel.

These problems can be avoided by using an inverter to control the motor, but this solution is, in most cases, too expensive. For this reason, generative down-drive, with the motor supplying energy to the mains, is usually not employed, but instead the motor is braked in such manner that the mechanical energy received from the pump is converted into heat in the motor. This results in a very low performance of the system and a substantially higher heat stress on the motor than e.g. in a valve-controlled system, in which the motor stands still throughout the down-travel phase.

SUMMARY OF THE INVENTION

An object of the present invention is to preserve the advantages of a simple motor-controlled system while improving its performance in a simple way and reducing heat stress of the motor.

Accordingly, one aspect of the invention provides a method for improving the performance of a motor-controlled hydraulic elevator, in which oil is pumped by means of an hydraulic pump controlled by an electric motor from a container via a main supply duct into a lifting cylinder to move the elevator upwards, and returned in a controlled manner through the pump into the container to move the elevator downwards, comprising, when the elevator is driven downwards, reducing the oil pressure in the main duct to a substantially predetermined constant level by means of a check valve which, in order to provide compensation for the pressure in the pump, has a feedback connection to said main supply duct via a pressure compensation valve which controls the volume of flow through the check valve.

Another aspect of the invention provides an apparatus for improving the performance of a motor-controlled hydraulic elevator, which apparatus comprises an hydraulic pump connected to an electric motor, an oil container, a main duct leading from the container to the pump and further to a lifting cylinder of the elevator, and a braking device for the elevator during downward drive consisting of a check valve for reducing the oil pressure and a pressure compensation valve connected to said check valve and sensing the pressure in the main duct, which valves enable the pressure in the hydraulic pump to be maintained at a substantially constant predetermined level.

The improvement in system performance provided by the invention is achieved through mimimization of the amount of electrical energy taken from the mains during down-drive. The improvement also results in a reduced heat stress on the motor and a lower working pressure in the pump. In addition, as explained below, a substantially faster response of the system in stopping the elevator car is achieved, enabling the car to be stopped more accurately by the invention than by previous systems.

BRIEF DESCRIPTION OF THE DRAWINGS

Further objects, features and advantages of the invention will become apparent to those skilled in the art from the following description thereof when taken in conjunction with the accompanying drawings, in which.

DESCRIPTION OF THE PREFERRED EMBODIMENTS

Figure 1:
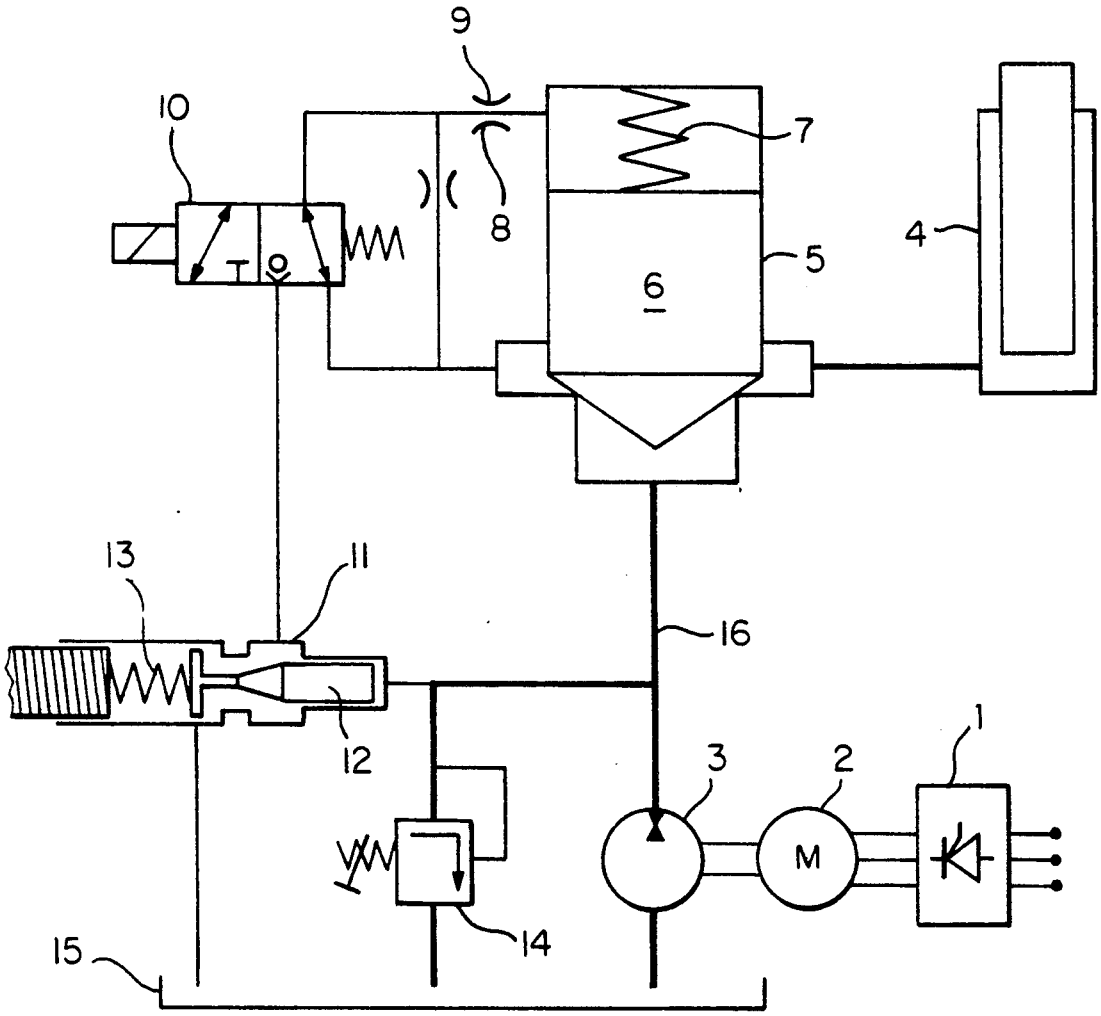
FIG. 1 is a diagram showing the principles of an embodiment of the invention.

Referring now to FIG. 1, an hydraulic pump 3 is driven by an electric motor 2 controlled by an ordinary thyristor drive unit 1, which is connected to a three-phase mains supply. The pump 3 communicates with an hydraulic lifting cylinder 4 through an hydraulic main duct 16 and a check valve 5. When the system is at rest, the check valve 5 is kept closed, i.e. a spindle 6 of the valve is held in the low position, by a spring 7 mounted at the upper end of the spindle and by the pressure of oil in the spring space.

When a magnetic valve 10 is energized, the oil in the space above the spindle 6 of the check valve 5 is allowed to flow to a container 15 via throttle 9, magnetic valve 10 and biased pressure compensation valve 11. The pressure in the space above the spindle 6 of the check valve 5 falls rapidly and the pressure in the hydraulic cylinder 4 begins to push up the spindle 6, gradually opening the check valve 5.

At this stage, the pump 3 starts running and oil begins to flow from the container 15 to the pump 3. At the same time, the increasing pressure begins to push a spindle 12 of the biased pressure compensation valve 11 towards the closed position until the oil pressure acting on the spindle 12 is equal to the pressure of a spring 13. The pressure in the pump 3 now ceases to increase because the equilibrium in biased pressure compensation valve 11 causes spindle 6 to stop at its current position, since the oil flow from the check valve 5 through throttle 8 is equal to the flow through the biased pressure compensation valve 11 and there is no net flow through throttle 9.

When the speed of rotation of the pump 3 changes, the pressure acting on spindle 12 also changes, disturbing its state of equilibrium and causing it to assume a new position, thus changing the flow through the biased pressure compensation valve 11. As a result, a net flow through throttle 9 occurs and spindle 6 moves in the corresponding direction so that the flow through check valve 5 corresponds to the flow through the pump, which means that the pressure in the pump is restored to the set value and spindle 12 returns to its balanced position. Since the pressure is thus kept constant, the speed of the elevator solely depends on the speed of rotation of the pump 3 and therefore on the position of spindle 6 in the check valve 5.

When the car approaches the desired level, it is moving at a low speed and the spindle 6 of check valve 5 is near its closed position. At the desired stopping point, the control current to the magnetic valve is switched off and check valve 5 is immediately closed, since the space above spindle 6 is filled with oil flowing through check valve 5 and throttles 8 and 9 from the hydraulic cylinder 4. Above all, the check valve 5 is closed quickly because, as provided by the invention, the spindle is already near its closed position when the elevator is moving at a low speed. The supply of electricity to the pump motor can then be switched off. As is known, in current elevator systems the spindle has no regulating function, which means that an essential advantage is achieved by the invention. Valve 14 is an obligatory safety valve and has no bearing on the operation of the system of the invention.

The pressure acting on the pump, and therefore the torque of the electric motor, is determined by the spring pressure of the spring 13 of the biased pressure compensation valve 11. This spring pressure is set in a simple way by means of an adjustment screw at the end of the valve preferably to such a value that only a fraction (e.g. 2 to 3 bars) of the pressure generated by the elevator car has to be received by the motor. In this way, most of the pressure generated by the car and the load as a whole is handled by the check valve 5. In fact, to achieve the maximum advantage, the pump load pressure is adjusted to such a value that, during downward drive, the pump is allowed to run with the lowest possible motor torque which enables the electrical control system to drive the elevator in keeping with a speed reference, e.g. a predetermined speed curve.

The elevator is upwardly driven in the known manner and the electric motor 2 and the pump 3 naturally have to be able to produce a full lifting pressure in the hydraulic cylinder 4. As stated before, the present invention aims at minimizing the heat stress of the motor resulting from the need to dissipate energy when the whole pressure of the hydraulic cylinder 4 is applied to the pump 3, as is the case in known systems. The above-mentioned minimization of pressure achieved by the invention also means that the apparatus of the invention generates no energy that could be supplied back to the mains, which makes it possible, for reasons mentioned before, to employ simple thyristor-based motor drives. Naturally, the invention allows the torque rotating the motor to be increased, if desired, to a value above the minimum so that, e.g. using an invertor, the motor 2 is enabled to function as a generator.

As an alternative to the embodiment of FIG. 1, the invention can also be implemented by replacing the check valve 5 with an ordinary check valve together with a controllable lowering valve connected in parallel with it and acting as a pressure compensation valve. Instead of a biased pressure compensation valve 11 it is also possible to use a directly controlled pressure compensation valve, in which the flow is both measured and regulated by the same spindle.

Figure 2:
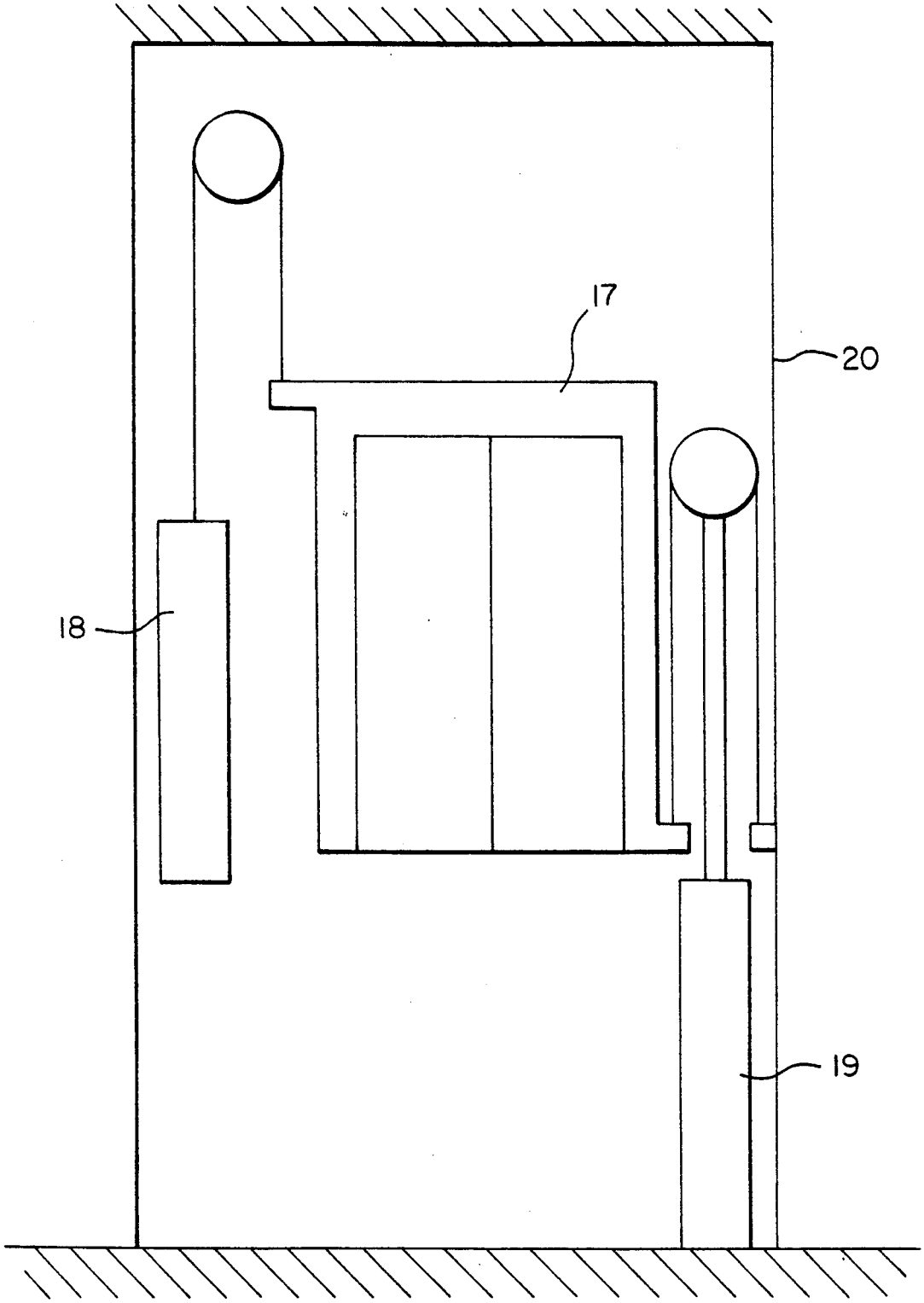
FIG. 2 shows an example of an arrangement relating to the installation of a car in an elevator shaft.

In an elevator system employing the method of the invention, counterweights like those found in normal elevator systems can also be used to advantage, as shown in FIG. 2, which represents an example of the installation of a car in an elevator shaft. In this figure, the elevator car is identified by reference number 17, the counterweight by number 18 and the lifting cylinder by number 19. For the sake of clarity, the elevator shaft 20 has been depicted as having an exaggeratedly low height dimension.

Normally, valve-controlled hydraulic elevators can not be provided with heavy counterweights because the pressure difference across the control valve decreases in proportion to the counterweight. In an ordinary control valve, this pressure difference must be considerable to ensure that the valve is controllable. In a system employing the present invention, the weight of the counterweight 18 may amount to between 70% and 80% of the weight of the elevator car 17, because the downward oil flow for downward movement of the elevator is initiated by the motor, which reliably opens the valve even when the pressure difference across check valve 5 in FIG. 1 is small. This further reduces the size of the electric motor, hydraulic pump and lifting cylinder required for the elevator, especially with regard to the lifting movement.

It will be obvious to a person skilled in the art that the scope of the invention is not restricted to the embodiments disclosed above, but may instead be varied within the scope of the following claims without departing from the spirit and scope of the invention.

I claim:

1. A method for improving the performance of a motor-controlled hydraulic elevator, in which oil is pumped from a container by a hydraulic pump driven by an electric motor, through a main supply duct, in which is disposed a regulating valve, into a lifting cylinder to move the elevator upwards, and returned to the container in a controlled manner through said regulating valve, said main supply duct, and said pump to move the elevator downwards, comprising, when the elevator descends, reducing the oil pressure in the main supply duct to a predetermined, substantially constant level by means of said regulating valve which is actively controlled by the pressure in the pump, via a feedback connection comprising a pressure compensation valve, so as to control the volume of flow from the lifting cylinder, and thereby control the rate of descent of the elevator.

2. A method according to claim 1, wherein the pressure loading the hydraulic pump is adjusted to a value such that, during downward drive, the pump is allowed to run with the lowest possible motor torque which enables the electrical control system to drive the elevator in keeping with a speed reference.

3. A method according to claim 1, wherein the elevator car is provided with a counterweight of a size that compensates a major proportion but not all of the weight of the car when empty.

4. A method according to claim 1, wherein the elevator car is provided with a counterweight of a size that compensates between 70 percent and 80 percent of the weight of the car when empty

5. A method according to claim 1, wherein the opening and closing of the regulating valve is controlled by a separate magnetic valve connected between the regulating valve and the pressure compensation valve.

6. A method for improving the performance of a motor-controlled hydraulic elevator, in which oil is pumped from a container by a hydraulic pump driven by an electric motor, through a main supply duct, in which is disposed a regulating valve, into a lifting cylinder to move the elevator upwards, and returned to the container in a controlled manner through said regulating valve said main supply duct, and said pump to move the elevator downwards, comprising, when the elevator descends, reducing the oil pressure in the main supply duct to a predetermined, substantially constant level by means of said regulating valve which is actively controlled by the pressure in the pump via a feedback connection comprising a pressure compensation valve, and controlling the opening and closing of the regulating valve by a separate magnetic valve connected between the regulating valve and the pressure compensation valve.

7. A method according to claim 6, wherein the pressure loading the hydraulic pump is adjusted to a value such that, during downward drive, the pump is allowed to run with the lowest possible motor torque which enables the electrical control system to drive the elevator in keeping with a speed reference.

8. A method according to claim 6, wherein the elevator car is provided with a counterweight of a size that compensates a major proportion but not all of the weight of the car when empty.

9. A method according to claim 6, wherein the elevator car is provided with a counterweight of a size that compensates between 70 and 80 percent of the weight of the car when empty.

* * * * *